US006604881B2

(12) United States Patent
Ruha et al.

(10) Patent No.: US 6,604,881 B2
(45) Date of Patent: Aug. 12, 2003

(54) APPLICATOR HEAD

(75) Inventors: David J. Ruha, New Hope, MN (US); Steven Thompson, Bloomington, MN (US)

(73) Assignee: Warner Manufacturing Co., Minneapolis, MN (US)

( * ) Notice: Subject to any disclaimer, the term of this patent is extended or adjusted under 35 U.S.C. 154(b) by 0 days.

(21) Appl. No.: 09/847,047

(22) Filed: May 1, 2001

(65) Prior Publication Data

US 2001/0053419 A1 Dec. 20, 2001

Related U.S. Application Data

(60) Provisional application No. 60/200,990, filed on May 1, 2000.

(51) Int. Cl.[7] ..... A47L 13/30

(52) U.S. Cl. ..... 401/263; 401/270; 401/280; 401/281; 401/278

(58) Field of Search ..... 401/263, 264, 401/275, 270, 272, 273, 140, 278, 279, 280, 281; 118/256, 263

(56) References Cited

U.S. PATENT DOCUMENTS

| | | | | | |
|---|---|---|---|---|---|
| 2,731,656 | A | * | 1/1956 | Payne | 401/275 |
| 5,213,432 | A | * | 5/1993 | Chappell | 401/273 |
| 6,213,667 | B1 | * | 4/2001 | Isaac | 401/289 |

* cited by examiner

*Primary Examiner*—David J. Walczak
(74) *Attorney, Agent, or Firm*—Merchant & Gould, P.C.

(57) ABSTRACT

An applicator head apparatus disposable on the end of a handle, including an applicator valve and a wiper head. The applicator valve further including a socket mounted on the wiper head and a coupling assembly with one end connected to the handle and the other end having a cylinder member rotatably mounted in the socket, the applicator valve having a first position preventing flow and a second position permitting flow.

11 Claims, 9 Drawing Sheets

APPLICATOR HEAD

This application claims the benefit of Provisional Application Ser. No. 60/200,990 filed May 1, 2000, entitled APPLICATOR HEAD.

BACKGROUND OF THE INVENTION

The present invention relates to an applicator head for use with an apparatus for the application of dry wall compound.

Apparatus including applicator heads for spreading mastic and other fluid or semi-fluid materials such as dry wall compound and the like are widely used. Such apparatus may have a valve to control the compound flow. However, when the applicator head is taking away from the work surface, such a valve needs a time period to be totally shut off. That is, when the applicator head is removed from the work surface, compound may still come out from the fluid pass due to the valve not being completely shut off instantly. Further, when applying compound onto the work surface, sometimes compound cannot reach along the wiper head of the applicator head, and thus causing an uneven thickness.

Therefore, there is a need for an applicator head with an improved applicator valve and fluid chamber design.

SUMMARY OF THE INVENTION

The present invention is related to an applicator head for applying drywall compound onto a work surface.

In a preferred embodiment of an applicator head in accordance with the principle of the invention, the applicator head includes an applicator valve and a wiper head. The applicator valve further includes a socket mounted on the wiper head, and a coupling assembly with one end connected to a handle and the other end having a cylinder member rotatably mounted in the socket. The applicator valve has a first position preventing flow and a second position permitting flow. Preferably, the applicator valve is open over a range of handle movement relative to the applicator head. The applicator valve is actuated by rotating the coupling assembly such as when moving the handle relative to the wiper head. A resilient means such as a spring is provided to connect the coupling assembly and the wiper head, so that the applicator valve normally is biased into a closed position.

In a further embodiment, the wiper head further includes a top plate and a bottom plate defining a fluid chamber. The bottom plate has a leading side with two rollers to guide the applicator head and a trailing side having a longitudinal slot opening for spreading compound onto the work surface and a blade protruding outwardly from the bottom plate positioned next to the longitudinal slot opening. The fluid chamber has a baffle structure to direct fluid flow along the longitudinal slot opening.

A variety of additional advantages of the invention will be set forth in part in the description which follows, and in part will be obvious from the description, or may be learned by practice of the invention. It is to be understood that both the foregoing general description and the following detailed description are exemplary and explanatory only and are not restrictive of the invention.

BRIEF DESCRIPTION OF THE DRAWINGS

FIG. 6 is a top view of the applicator head according to one embodiment of the present invention.

DISCLOSURE OF THE PREFERRED EMBODIMENT

Figure 1:
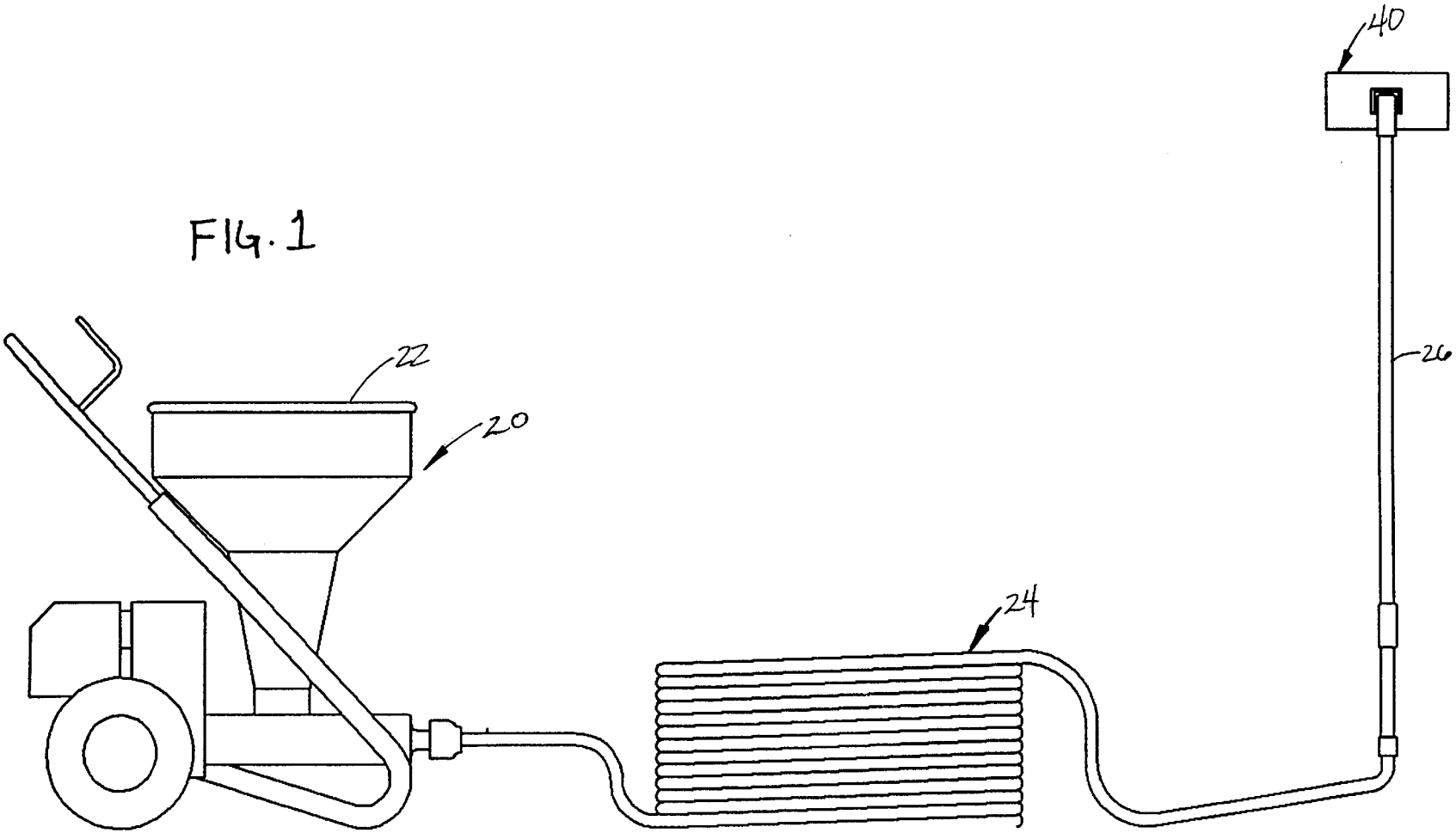
FIG. 1 shows an embodiment of an applicator head in accordance with the principles of the present invention connecting to a pumping system.

Referring to FIG. 1, there is shown a pump system 20 connecting to an applicator head 40 through a hose 24 and a hollow handle 26. The pump system 20, the hose 24, the handle 26 and the applicator head 40 define a fluid pass, so that drywall compound is transferred from the hopper 22 of the pump system 20 to the applicator head 40 continuously to apply to a work surface.

Figure 2:
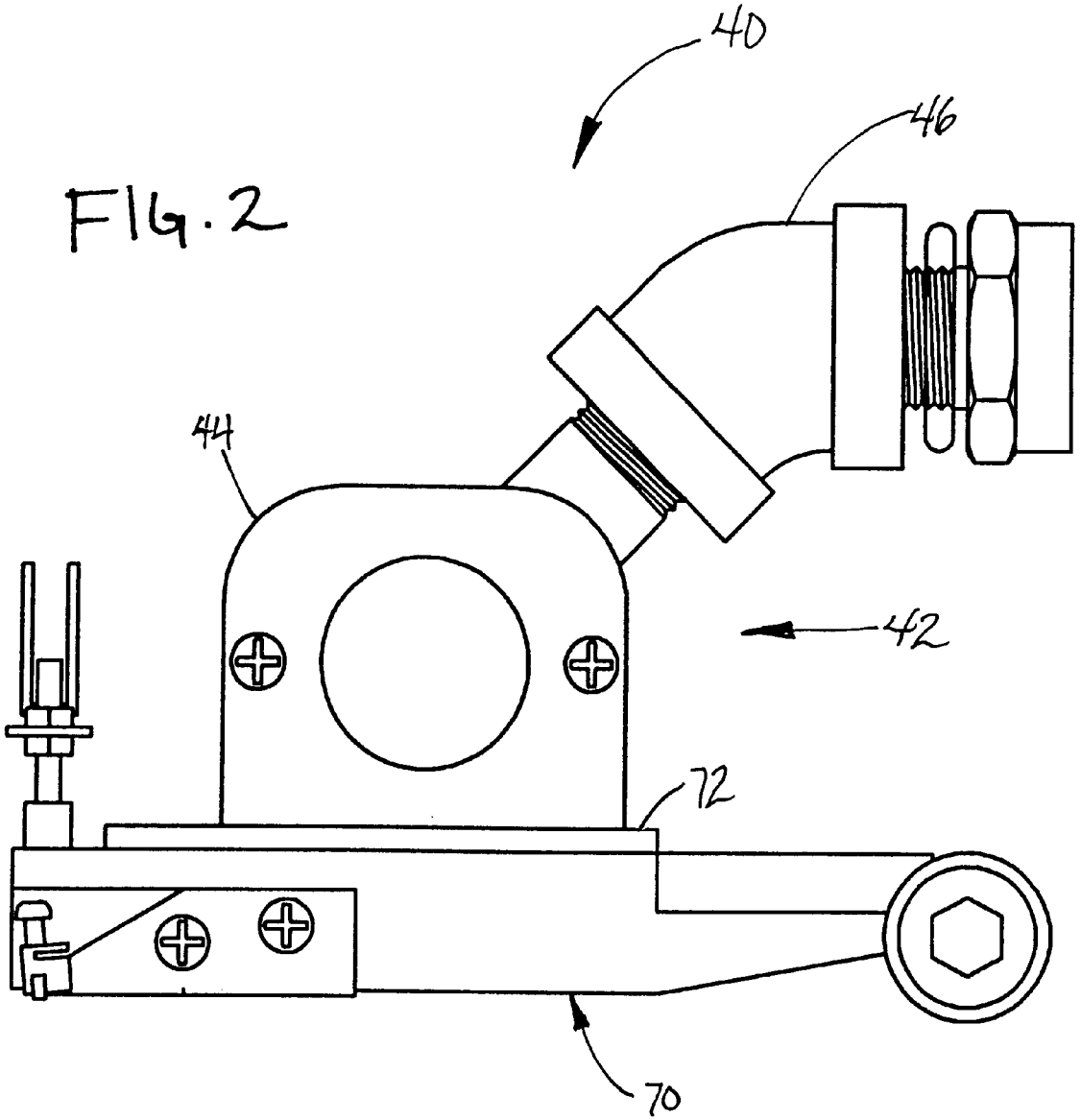
FIG. 2 is a side view of an applicator head according to one embodiment of the present invention.
Figures 3A, 3B, 3C:
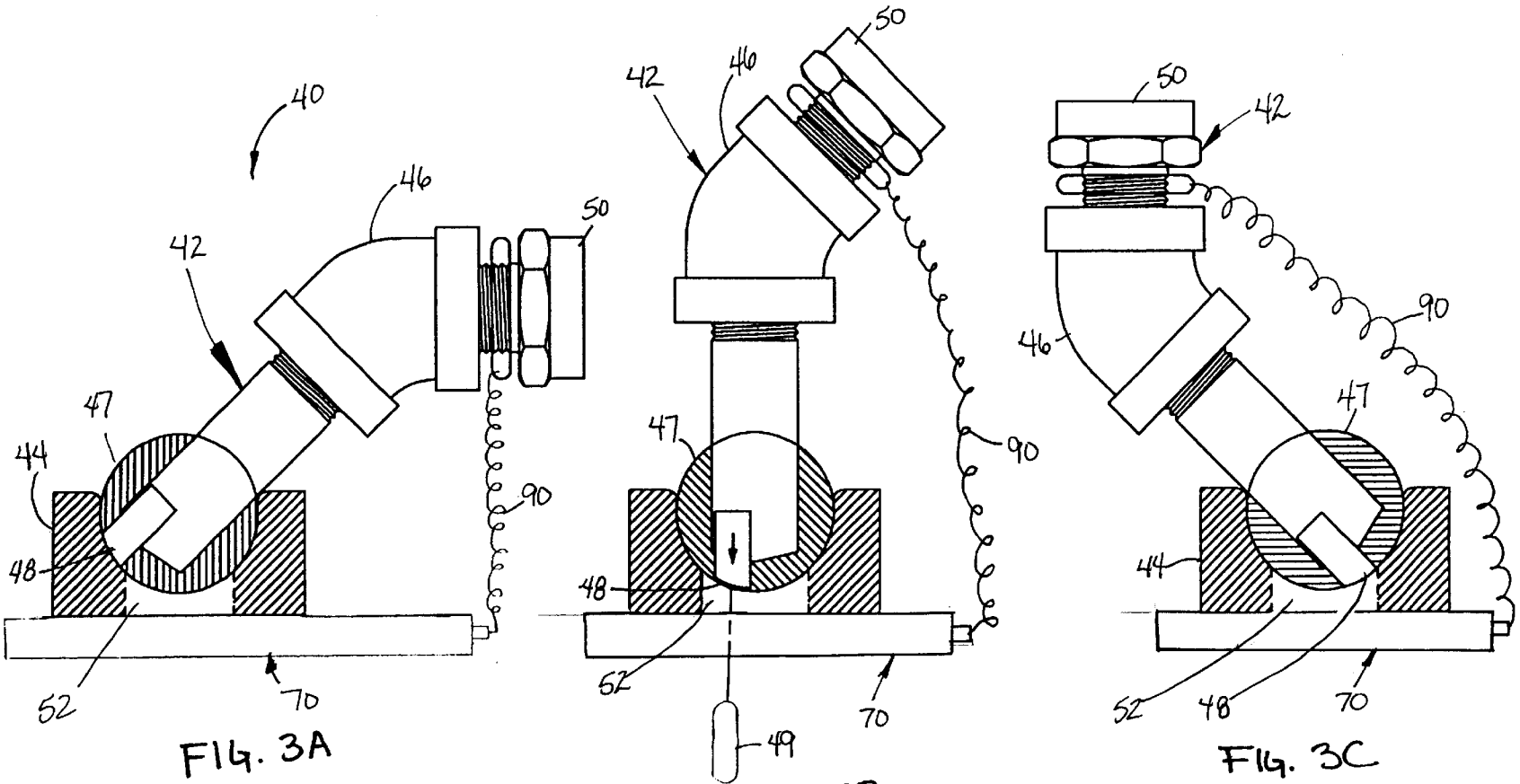
FIGS. 3*a*–3*c* are partial cross-section views of an applicator valve in different positions to prevent/permit flow.
Figure 4:
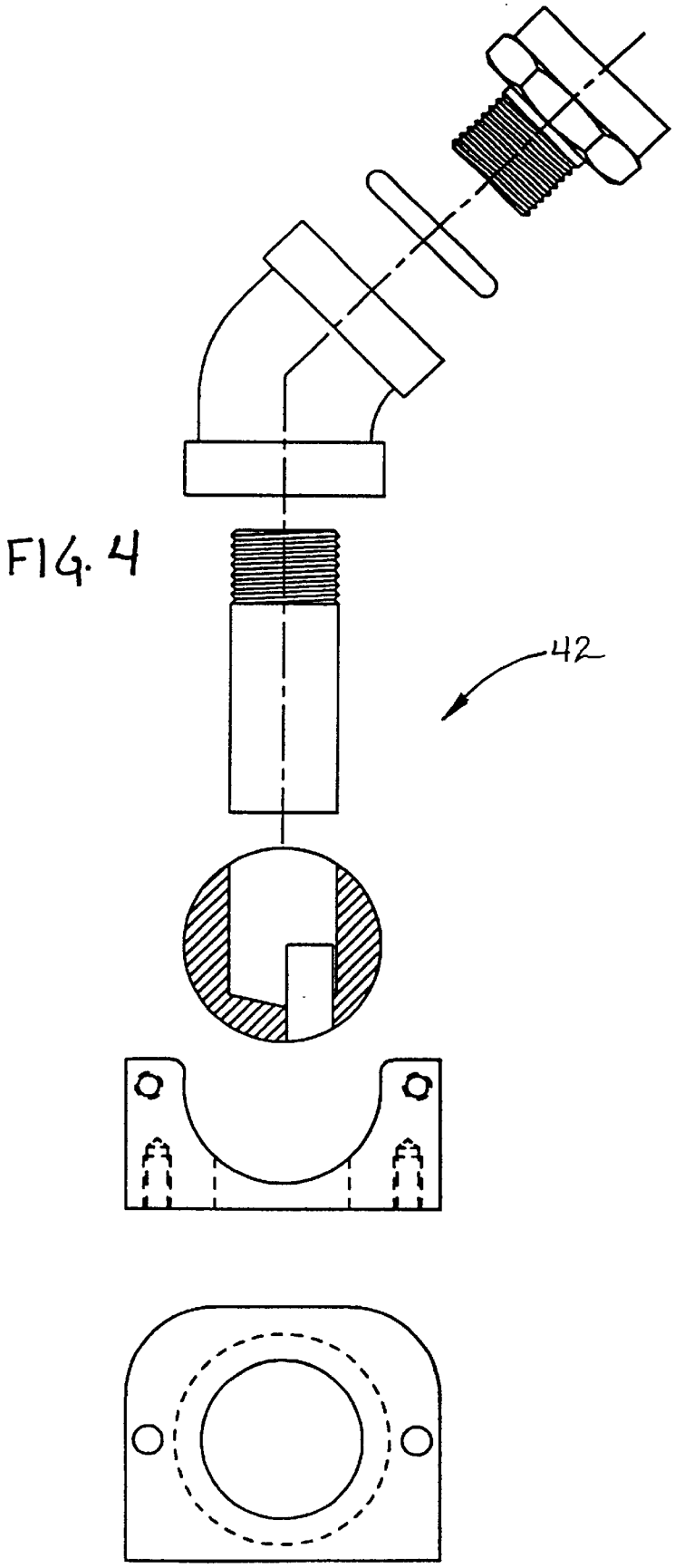
FIG. 4 is a perspective view showing the elements of the applicator valve in exploded relationship to one another.

The applicator head 40, as shown in FIG. 2, includes an applicator valve 42 and a wiper head 70. The applicator valve 42 has a socket 44 mounted on a top plate 72 of the wiper head 70. A coupling assembly 46 is attached to a cylindrical member 47 which rotates in the socket 44 upon movement of the coupling assembly 46. The applicator valve 42 is actuated by rotating the coupling assembly 46, which rotates the cylindrical member 47 in the socket 44. FIGS. 3*a*–3*c* show various relative positions of the cylindrical member 47 in the socket 44. A spring 90 is provided to connect the coupling assembly 46 and the wiper head 70. The spring 90 biases the coupling assembly 46 and its cylindrical member 47 into a closed position, wherein a slot 48 of the cylindrical member 47 is enclosed by an inside wall of the socket 44, so as to prevent compound flow through the slot 48. This shows in FIG. 3*a*, in which the applicator valve 42 is in a closed position. During application, the user presses the applicator head against a work surface using the handle which is threadedly connected to the applicator head 40 through an end 50, so as to actuate the applicator valve 42. As shown in FIGS. 3*b*–3*c*, in the open position, the slot 48 directs compound flow to an opening 52 to permit compound flowing to the wiper head 70. In the present invention, it is preferred that the slot 48 is in an oval shape 49, so that the applicator valve 42 is actuated with less movement compared with an applicator valve having a circular-shaped slot. FIG. 4 shows the applicator valve 42 of FIGS. 3*a*–3*c* in an exploded view.

Figure 5:
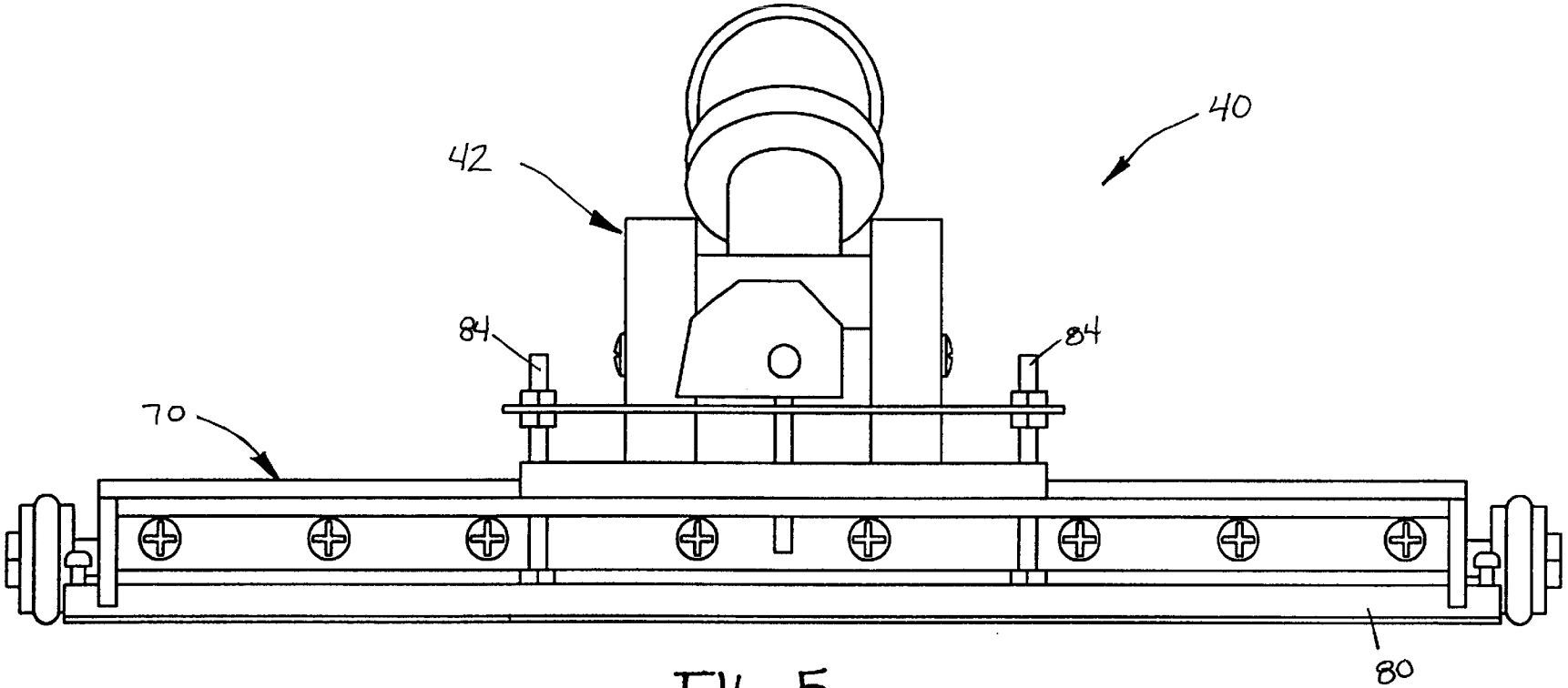
FIG. 5 is a front view of the applicator head according to one embodiment of the present invention.
Figure 7:
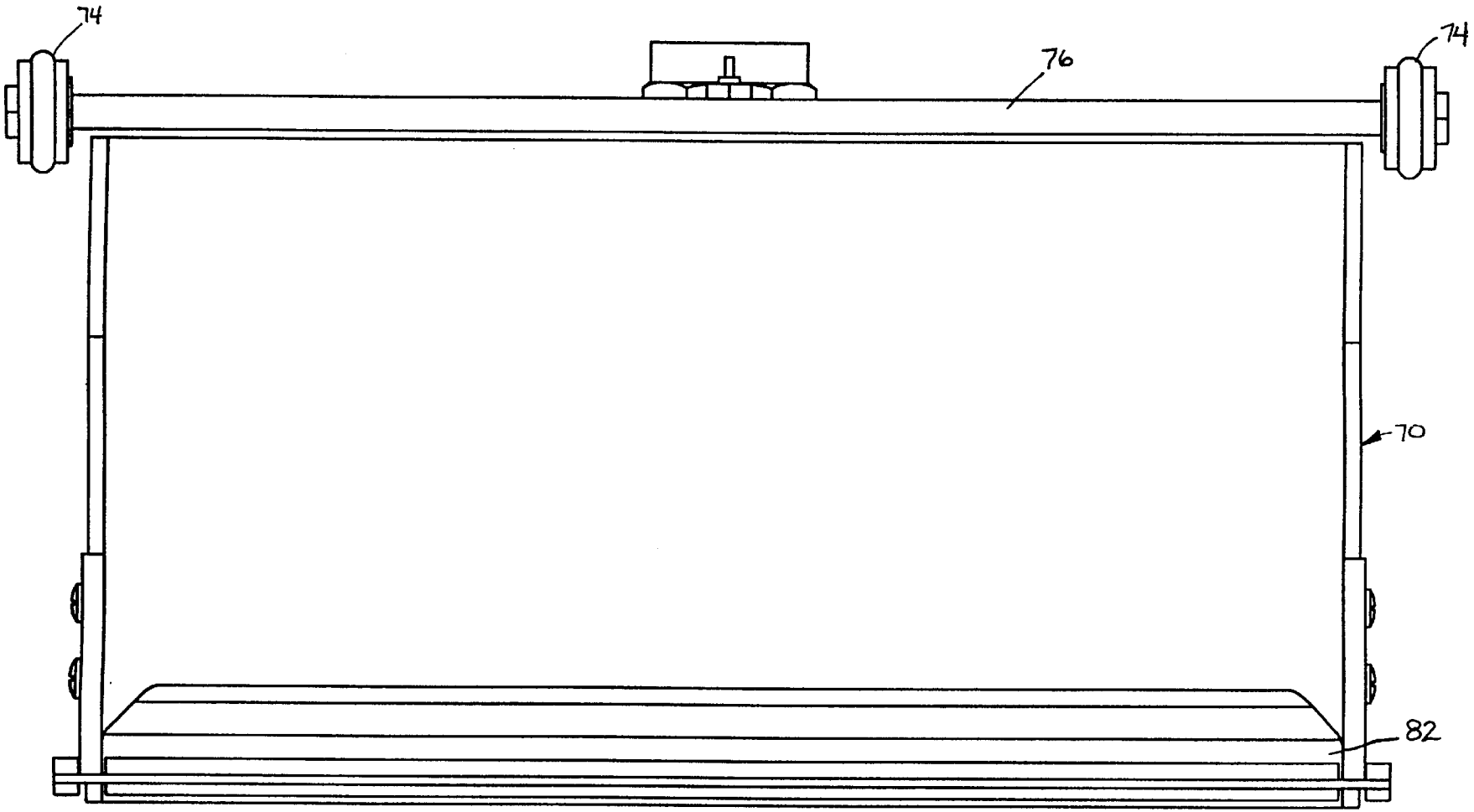
FIG. 7 is a bottom view of the applicator head according to one embodiment of the present invention.

Now referring to FIGS. 5–7, which show front, top and bottom views of the applicator head 40, respectively. The applicator valve 42 is mounted on the wiper head 70. The wiper head 70 has a leading side and a trailing side. On the leading side, a pair of rollers 74 rotatably attached to a bar 76 which in turn is mounted to a bottom plate 78. The rollers 74 allow the applicator head 40 to easily slide along a work surface during application. One end of the spring 90 is mounted onto the bar 76. On the trailing side, a blade 80 is mounted onto and protruded outwardly from the bottom plate 78, and a longitudinal slot opening 82 is positioned at the bottom side of the bottom plate 78 next to the blade 80. Compound comes out from the slot opening 82 and is spread evenly by using the blade 80 against the work surface. The degree of curvature of the blade 80 can be controlled by exerting a controllable force on the blade 80 by means of threaded bolts 84 attached to the blade 80. That is, the blade 80 may be curved from the center to either or both ends by adjusting the position of the threaded bolts 84. Thus, compound in the center would be thicker than that at the ends. It is especially useful for butt joints and/or taper joints.

Figure 8:
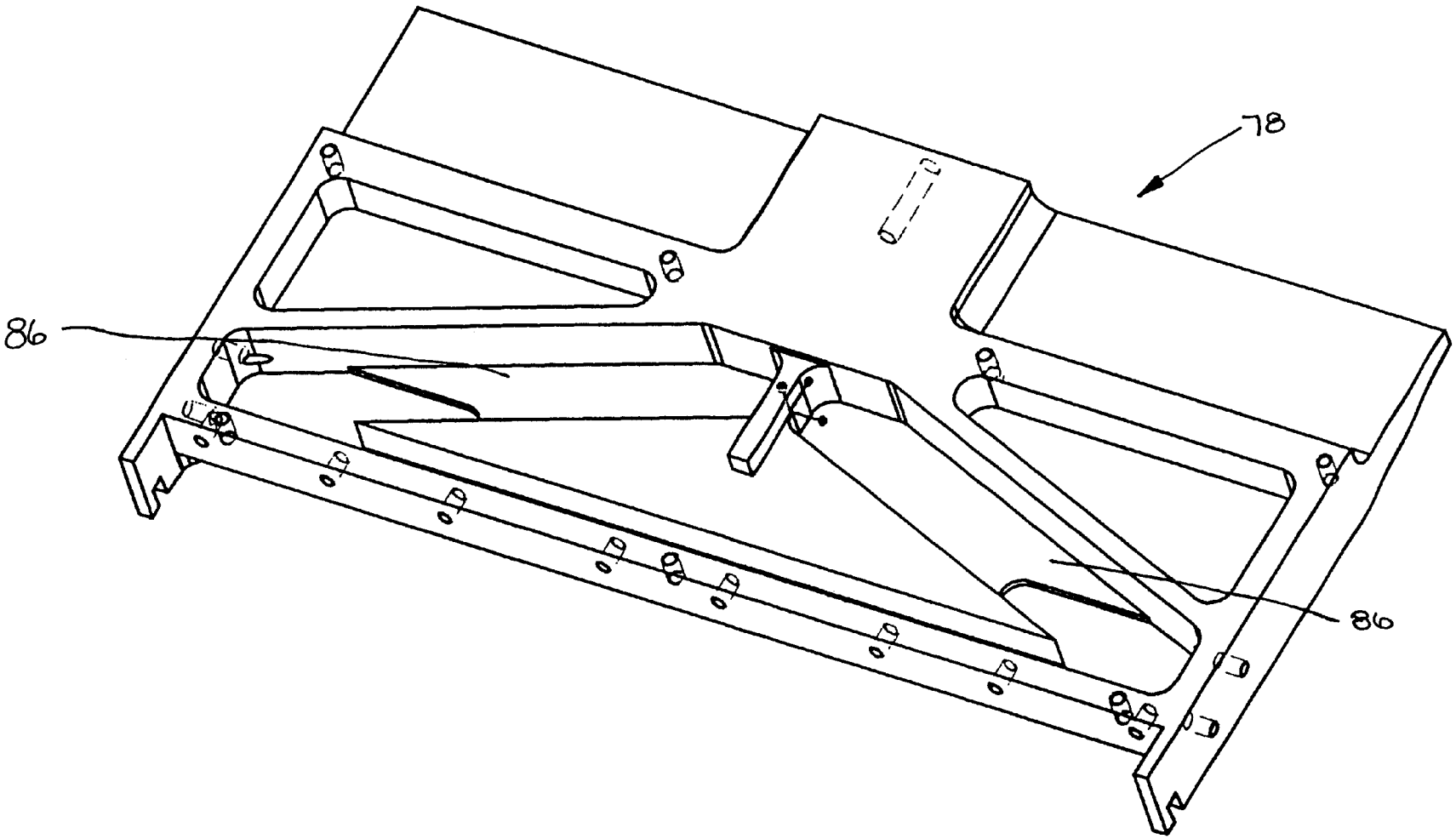
FIG. 8 shows inner structure of a wiper head according to one embodiment of the present invention.
Figure 9:
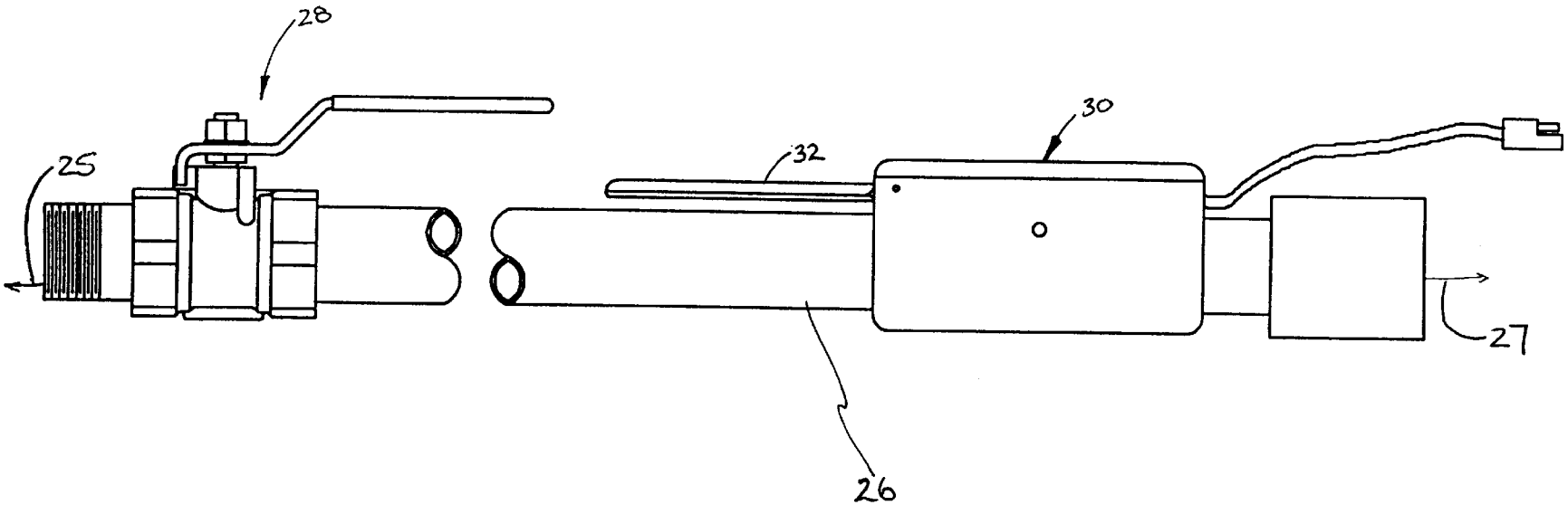

FIG. 8 shows the inner structure of a bottom plate 78 which has a baffle structure for directing compound flow along the blade 80. Grooves 86 are formed to direct compound flowing to both sides of the slot opening 82, and then flowing to the center of the slot opening 82. By such a way, compound can be evenly spread both the center and the sides, so that the sides of the slot opening 82 would have enough compound. The fluid chamber is defined by mounting the top plate 72 onto the bottom plate 78.

Figure 9:
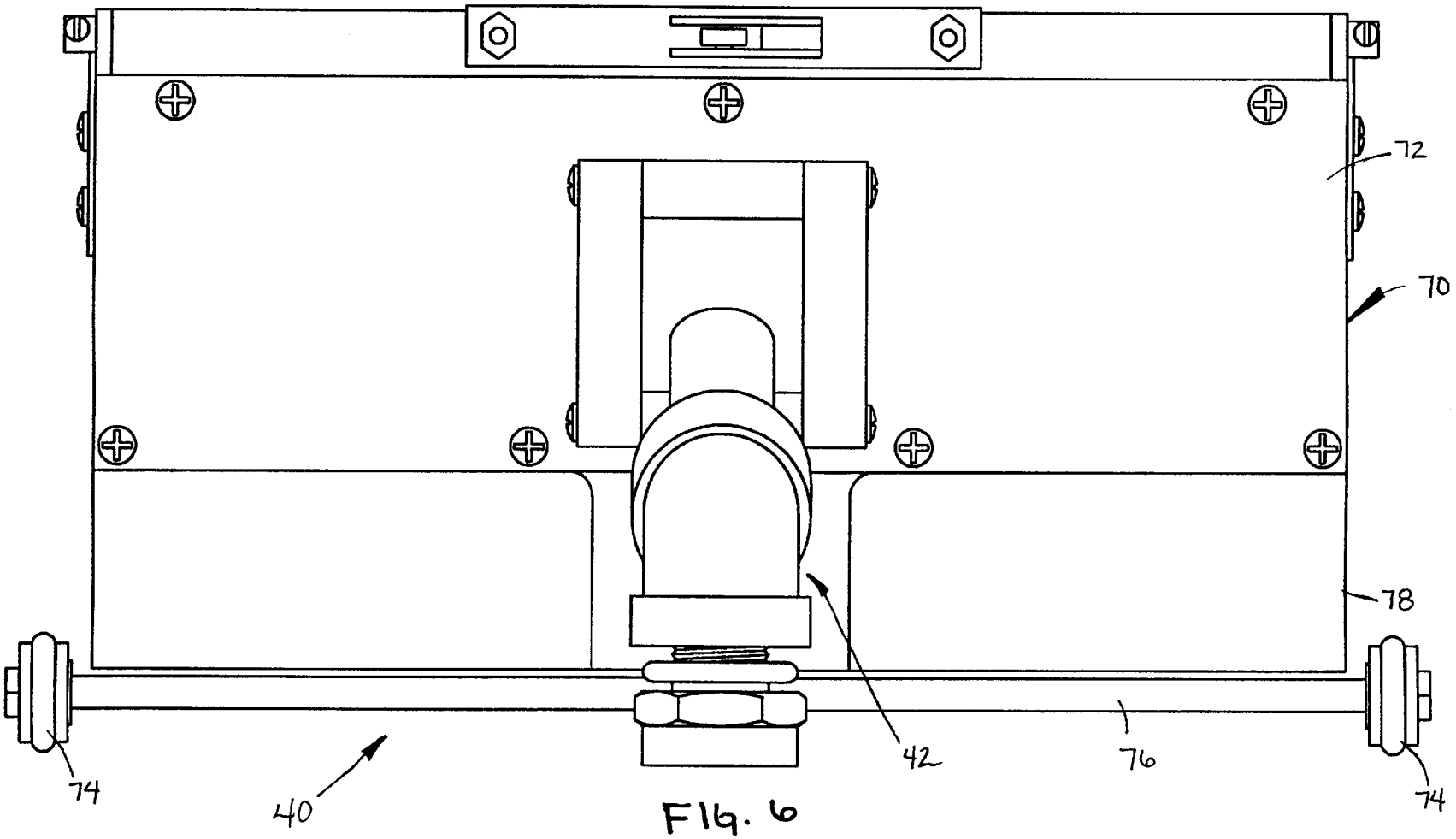
FIG. 9 shows a handle with one end connecting to an applicator head and the other end connecting to a hose.

FIG. 9 shows the hollow handle 26 with one end 25 connecting to the applicator head 40 and the other end 27 connecting to the hose 24 or other conduit defining a fluid path for compound. The handle 26 has a shut-off valve 28 at the side of the applicator head. The shut-off valve 28 is used to prevent compound flowing to the applicator head when changing or taking out the applicator head. The handle 26 further has a switch 30 electrically connected to the pump system 20. The user can turn on/off the pump system 20 by pressing/releasing the lever 32 of the switch 30.

In use, upon turning on the pump system, the user applies the applicator head onto the work surface. By pulling up the handle, an evenly spread compound is applied onto the work surface continuously.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description.

What is claimed is:

1. An applicator head apparatus disposable on the end of a handle, comprising:

an applicator valve;

a wiper head;

the applicator valve further including a socket mounted on the wiper head and a coupling assembly with one end connectable to the handle and the other end having a cylinder member rotatably mounted in the socket, the applicator valve having a first position preventing flow and a second position permitting flow; and the wiper head including a fluid chamber enclosed therein, said fluid chamber is defined by an inner structure of the wiper head for directing material flow, said inner structure is arranged and configured to allow material to be evenly spread on a surface; wherein the wiper head is defined by an upper plate and a lower plate enclosing the fluid chamber and the inner structure is formed on to lower plate.

2. An apparatus in accordance with claim 1, wherein the applicator valve is open over a range of handle movement relative to the applicator head.

3. An apparatus in accordance with claim 2, wherein the applicator valve is actuated by rotating the coupling assembly such as when moving the handle relative to the wiper head.

4. An apparatus in accordance with claim 3, wherein a resilient member is provided to connect the coupling assembly and the wiper head, so that the applicator valve normally is biased into a closed position.

5. An apparatus in accordance with claim 4, wherein the resilient member is a coil spring.

6. An apparatus in accordance with claim 5, wherein the cylinder member has an oval opening.

7. An apparatus in accordance with claim 6, wherein the wiper head has a plurality of grooves for distributing material flowing through the grooves along a blade of the wiper head.

8. An apparatus for spreading materials on a surface, comprising:

a pump system connected with a conduit, the pump system capable of pumping materials through the conduit;

an applicator head connected to a handle, the handle being connected to the conduit; the applicator head including an applicator valve and a wiper head and;

a flow path is defined from the pump system to the applicator head;

the applicator valve is disposed in the applicator head, the applicator valve being normally biased into a closed position, the applicator valve being opened upon pivotal movement of the handle relative to the applicator head so as to allow material to flow through the flow path and the wiper head including a fluid chamber enclosed therein, said fluid chamber is defined by an inner structure of the wiper head for directing material flow, said inner structure is arranged and configured to allow material to be evenly spread on a surface; wherein the wiper head is defined by an upper plate and a lower plate enclosing the fluid chamber and the inner structure is formed on the lower plate.

9. A method for spreading materials on a surface using a pump system connected by a conduit to a handle which in turn is attached to an applicator head; comprising the steps of:

activating the pump system to pump the materials;

positioning the applicator head on a surface on which materials are to be spread;

causing flow of materials through the applicator head to the surface upon pivotal movement of the handle relative to the applicator head; and directing the flow of materials through the applicator head so that the materials are evenly spread on the surface; whereby the materials are evenly spread by directing the flow of materials through a wiper head of the applicator head, the wiper head having an inner structure defined by an upper plate and a lower plate enclosing a fluid chamber and the inner structure is formed on the lower plate.

10. A method in accordance with claim 9, further comprising the step of normally biasing the handle into a position wherein the flow of applicator materials through the applicator head is prevented.

11. The apparatus in accordance with claim 1, wherein the inner structure defines at least one groove in fluid communication with the applicator valve to deliver material to a slot opening longitudinally extending along the lower plate of the wiper head, said groove is arranged and configured to first direct the flow of material towards outer sides of the slot opening and then to direct the flow of material towards the center of the slot opening.

* * * * *